US008015654B2

(12) United States Patent
Faiola

(10) Patent No.: US 8,015,654 B2
(45) Date of Patent: Sep. 13, 2011

(54) HAND AND FINGERNAIL CLEANING APPARATUS

(75) Inventor: Norman Faiola, Ithaca, NY (US)

(73) Assignee: Syracuse University, Syracuse, NY (US)

( * ) Notice: Subject to any disclaimer, the term of this patent is extended or adjusted under 35 U.S.C. 154(b) by 861 days.

(21) Appl. No.: 10/538,910

(22) PCT Filed: Dec. 19, 2003

(86) PCT No.: PCT/US03/40564

§ 371 (c)(1), (2), (4) Date: Jun. 14, 2005

(87) PCT Pub. No.: WO2004/056232

PCT Pub. Date: Jul. 8, 2004

(65) Prior Publication Data

US 2006/0123572 A1 Jun. 15, 2006

(51) Int. Cl.
*A46B 11/06* (2006.01)
*A46B 15/00* (2006.01)

(52) U.S. Cl. ..... 15/160; 15/246; 4/606; 4/628

(58) Field of Classification Search ..... 15/104.92, 15/160, 161, 167.3, 205.2, 220.4, 246; 4/606, 4/628; 401/9

See application file for complete search history.

(56) References Cited

U.S. PATENT DOCUMENTS

| | | | | | |
|---|---|---|---|---|---|
| 526,390 | A * | 9/1894 | Glauber | 4/654 |
| 1,329,694 | A | 2/1920 | Beck | |
| 1,519,721 | A * | 12/1924 | Burkart | 15/246 |
| 1,553,915 | A * | 9/1925 | Rix et al. | 15/220.4 |
| 1,587,353 | A * | 6/1926 | Pfeufer | 4/606 |
| 1,771,934 | A * | 7/1930 | Marangoni | 15/74 |
| 1,871,208 | A * | 8/1932 | Bouchard | 15/220.4 |
| 2,019,705 | A * | 11/1935 | Hubert | 15/74 |
| 2,237,761 | A * | 4/1941 | Leano | 15/160 |
| 2,514,743 | A * | 7/1950 | Carson | 4/559 |
| 2,575,361 | A * | 11/1951 | Reip | 15/220.4 |
| 2,650,384 | A * | 9/1953 | McClaskey | 15/220.4 |
| 3,747,150 | A * | 7/1973 | Kozub | 15/105 |
| 4,757,571 | A * | 7/1988 | Young | 15/167.3 |
| 4,945,598 | A * | 8/1990 | Racioppi | 15/160 |
| 5,577,289 | A * | 11/1996 | Russell | 15/114 |
| 5,598,602 | A * | 2/1997 | Gibson | 15/220.4 |
| 6,029,292 | A * | 2/2000 | Leiferman et al. | 4/621 |
| 6,733,016 | B2 * | 5/2004 | Chung | 280/47.24 |

* cited by examiner

*Primary Examiner* — Randall Chin
(74) *Attorney, Agent, or Firm* — Christopher R. Pastel; Pastel Law Firm

(57) ABSTRACT

An apparatus for washing hands and/or fingernails includes a brush assembly attached to a water faucet. The brush assembly includes a backplane with two opposed brushes attached to the backplane such that the bristles on each brush face outward from the backplane. A clamping mechanism removable attaches the brush assembly to the faucet. The clamping mechanism is pivotable on the faucet so the user can move the brush assembly into the water stream to use the brushes and out of the water stream for rinsing.

3 Claims, 4 Drawing Sheets

HAND AND FINGERNAIL CLEANING APPARATUS

FIELD OF THE INVENTION

This invention relates generally to the field of brushes used to clean hands and fingernails of humans, and more particularly to a brush that is a convenient fixture at its point of use, for example, at a sink.

BACKGROUND OF THE INVENTION

Foodservice and medical workers are required to wash their hands frequently using a fingernail brush. Having a fingernail brush at the washing sink is therefore common. Typically, the brush is left on the sink top or shelf where surfaces may be unhygienic. Further, with wet and soapy hands it is easy to drop a fingernail brush on the floor, thereby contaminating the brush and inconveniencing the worker. Further, if the brush is on a shelf and not in the immediate field of view of the worker, the worker may forget to use it altogether. It is therefore considered useful to provide a combination of brush and fixture means to preserve hygiene and prevent the worker from dropping or forgetting to use the brush.

SUMMARY OF THE INVENTION

The present invention relates to a brush assembly that is located at a cleaning or work station. The brush assembly includes a brush attached to a brace. In one embodiment, the brush assembly is fixedly or removably mounted at a suitable location in or around a cleaning or work station. In one embodiment the brush is removably attached to the brace.

A brush assembly is mounted at a wash sink which conveniently allows a worker to manipulate the brush assembly for use. In one embodiment, the worker is able to swing the mounted brush under the water stream, use the brush for hand and fingernail cleaning without having to hold or support the brush manually, and swing the brush back to its original position out from the water stream. Preferably, at all times, the brush is suspended in the air and kept off unhygienic surfaces.

Briefly stated, an apparatus for washing hands and/or fingernails includes a brush assembly mounted proximate a cleaning or work station, preferably proximate a sink, and most preferably proximate a water faucet. In one embodiment, the brush assembly includes a backplane with two opposed brushes attached to the backplane such that the bristles on each brush face outward from the backplane. A clamping removably mechanism removably attaches the brush assembly to the faucet. The clamping mechanism is preferably pivotable on the faucet so the user can move the brush assembly into the water stream to use the brushes and out of the water stream for rinsing.

According to an embodiment of the invention, an apparatus includes a brush assembly; the brush assembly including a backplane with two opposed brushes attached to the backplane such that a plurality of bristles on each brush face outward from the backplane; and a clamping mechanism which attaches the brush assembly to a faucet.

According to an embodiment of the invention, a cleaning apparatus includes a brush assembly having a brush and a brace, wherein the brush is attached to the brace and the brace engages an element of a work station.

According to an embodiment of the invention, a cleaning apparatus includes a brush assembly which includes a brush removably attached to a brace; the brush having at least one cleaning surface; and wherein the brace is selectively engageable with a faucet such that the brace is capable of being manipulated with respect to the faucet.

While one possible application of the present invention is in connection with washing hands, many other applications are possible and references to use as a hand and nail brush should not be deemed to limit the uses of the present invention. While certain embodiments are discussed herein, they should not be interpreted as being the only embodiments of the present invention and other embodiments may be created without departing from the present invention. These and other objects and advantages of the present invention will become apparent from the detailed description, claims, and accompanying drawings.

DETAILED DESCRIPTION OF THE PREFERRED EMBODIMENT

Figure 1:
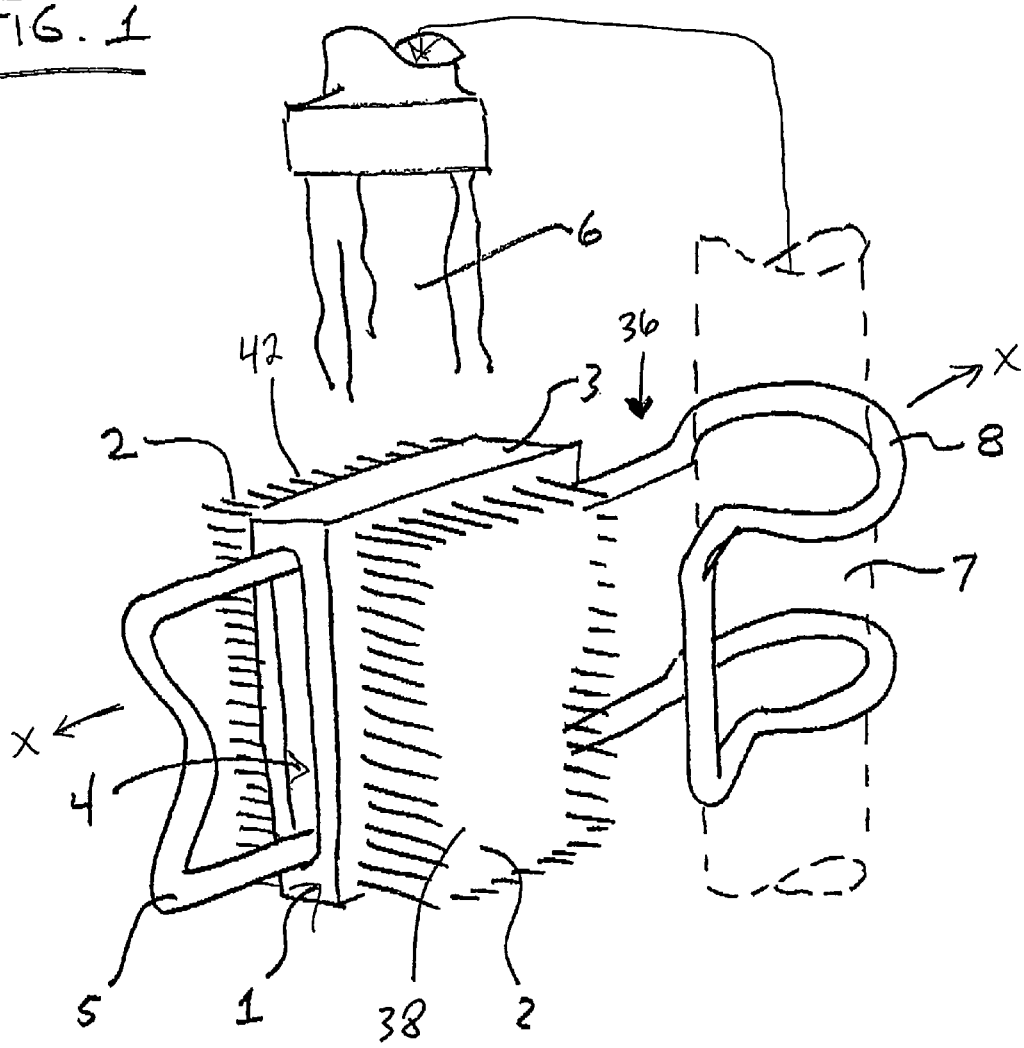
FIG. 1 shows a perspective view of a first embodiment of the present invention.

Referring to FIG. 1, the present invention relates to a brush assembly 1 that is fixedly or removably mounted proximate a cleaning or work station, preferably proximate a sink, and most preferably proximate a faucet 7. The brush assembly 1 includes a brush 38 attached to a brace 36. In one embodiment brush 38 is removably attached to brace 36. Brush 38 may take any number of forms, including but not limited to a brush with a single cleaning surface 42 or a plurality of cleaning surfaces 42. The cleaning surfaces 42 of brush 38 may be positioned on any portion of brush 38. In one embodiment, cleaning surfaces 42 of brush 38 are selectively removable from brush 38. Cleaning surfaces 42 may be of any form or material capable of satisfactorily cleaning the hands or nails of a person. For example, cleaning surfaces 42 may include a plurality of bristles 2, cloth, material containing cleaning agent, foam, a pad or sponge brush, or any combination thereof. Cleaning surfaces 42 may be manufactured of natural or synthetic materials or any combination thereof. Brush 38 may also be fabricated from a variety of materials such as plastic, wood, metal, or combination thereof. Likewise, brace 36 may take any number of forms. Brace 36 may be relatively straight, angled, or able to be manipulated. Brace 36 may be mounted proximate a sink in any manner suitable and at any location on the sink or faucet. For example, in one embodiment, brace 36 is engaged to faucet 7 via a'clamp or clamping portion 8. In another embodiment, brace 36 is engaged to the nozzle or open end of faucet 7.

In the embodiment of FIG. 1, a brush assembly 1 includes a plurality of flexible bristles 2 extending outward from each side of a rigid backplane 3. Backplane 3 preferably incorporates at least one hole 4 extending through it along an axis X-X of brush assembly 1 in the plane of the backplane. A rigid mounting member 5 preferably extends through hole 4, with a clamping portion 8 of member 5 adapted to clamp over an upright faucet. Brush assembly 1 is adjustably positioned on rigid mounting member 5 to the desired position so that it is firmly retained during ordinary washing use. The desired preferable position for placement of brush assembly 1 on rigid mounting member 5 is under a water stream 6 when clamping portion 8 is attached to faucet 7. In the preferred embodiment, member 5 holds brush assembly 1 through a combination of close dimensional tolerances and the frictional interplay of brush assembly 1, hole 4, and rigid mounting member 5.

Bristles 2 of brush assembly 1 are preferably fabricated from natural or synthetic materials as is well known in the art. Backplane 3 is preferably fabricated from one or more materials selected from the group of materials consisting of wood, thermoplastics, fiber-reinforced plastics, painted steel, polymer coated steel, galvanized steel, chromed steel, stainless steel, and aluminum. In the preferred embodiment, the entire brush assembly 1 including bristles 2 and backplane 3 are integrally molded in thermoplastic.

Rigid mounting member 5 is preferably fabricated from a material selected from the group of materials consisting of thermoplastics, fiber-reinforced plastics, painted steel, polymer coated steel, galvanized steel, chromed steel, stainless steel, and aluminum. Rigid mounting member 5 is attached to or integral with the brush assembly 1. Member 5 and its clamping portion 8 must provide the structural strength to maintain brush assembly 1 in a relatively steady cantilevered position while the worker scrubs his or her hands and fingernails on them.

In one embodiment, clamping portion 8 is preferably formed in an integral, resilient spring detent that has a flexible bend diameter smaller than common faucet diameters, permitting it to be snapped firmly onto the upright portion of most commercial faucets and easily pivoted about the faucet.

Figure 2:
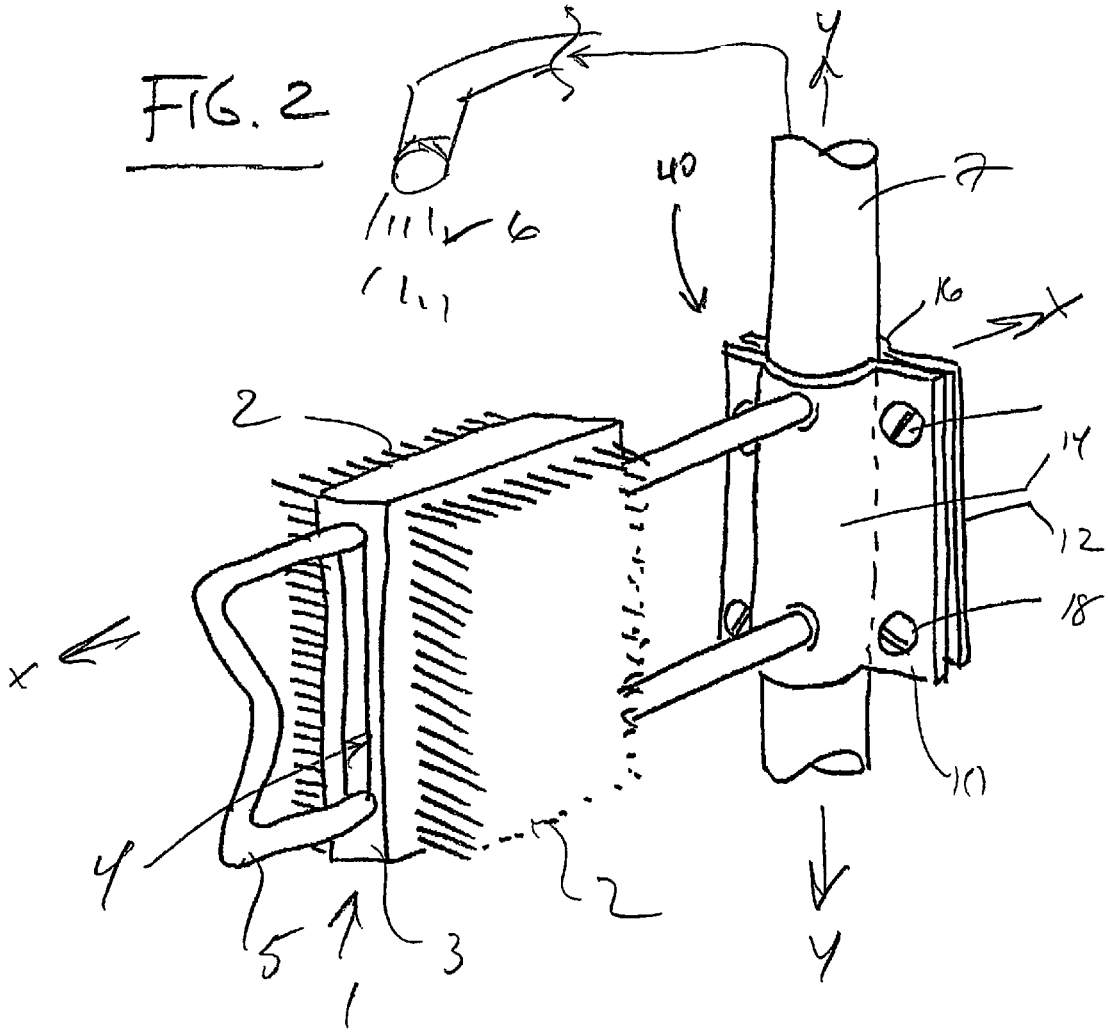
FIG. 2 shows a perspective view of a second embodiment of the invention.

In another embodiment, shown in FIG. 2, a fastener adjustable clamp 40 is shown in which front and rear clamp plates 10 and 12, respectively, preferably include axially aligned holes formed therethrough in flat portions thereof, and medial curved portions 14, 16 extending along longitudinal axis Y-Y that is transverse to axis X-X. Fasteners 18, such as bolts with nuts or wing-nuts, or machine screws if the openings are threaded, pass through the axially aligned openings. The radius of curvature of medial portions 14, 16 is slightly less than the radius of curvature of faucet 7 permitting them to be clamped firmly onto the upright portion of most commercial faucets.

Figure 3:
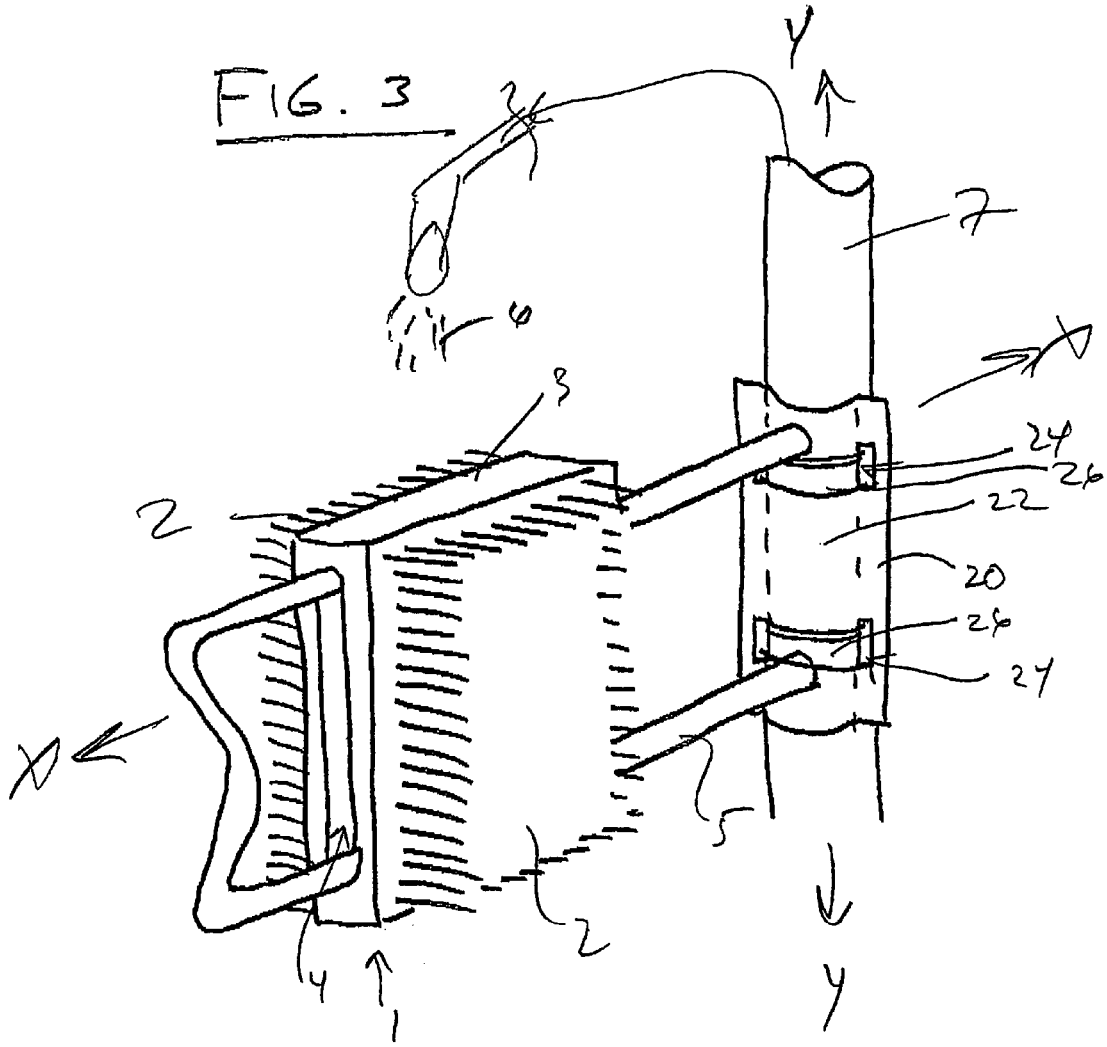
FIG. 3 shows a perspective view of a third embodiment of the invention.

In yet another embodiment, shown in FIG. 3, a plate 20 includes a medial curved portion 22 extending along axis Y-Y, and laterally aligned pairs of openings 24 formed through plate 20 on opposite sides of medial portion 22. Flexible straps 26 are laced through opposing openings 24, and securely fastened around faucet 7. Flexible straps can be of such materials as plastic, leather, metal, or cloth as long as the material is flexible and doesn't rust or unduly oxidize. The radius of curvature of medial portion 22 is slightly less than the radius of curvature of faucet 7 permitting it to be clamped firmly onto the upright portion of most commercial faucets.

Figure 4:
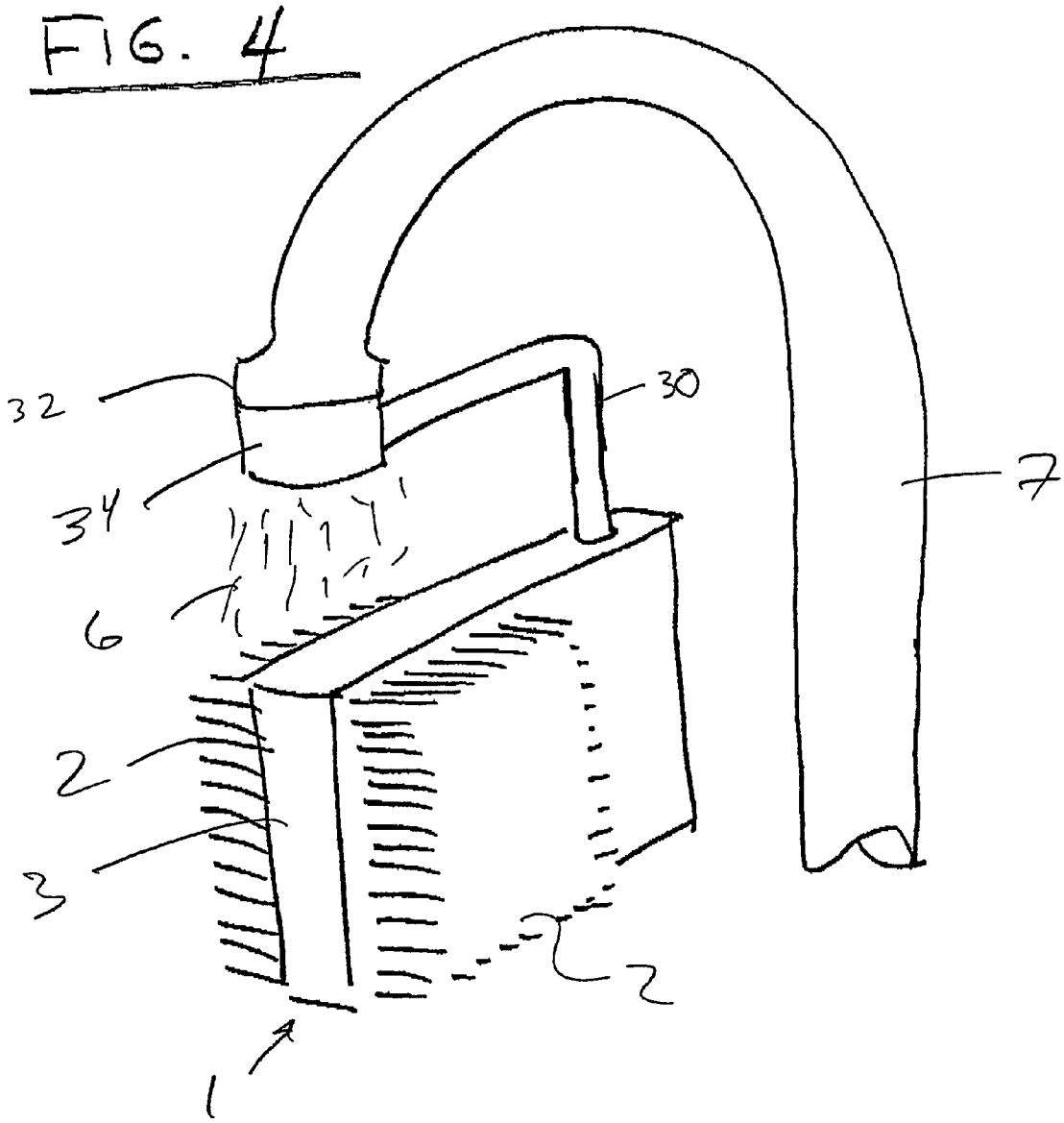
FIG. 4 shows a perspective view of a fourth embodiment of the invention.

Referring to FIG. 4, a further embodiment is shown which does not include mounting member 5 or hole 4. The clamping mechanism of this embodiment includes a rod 30 that interconnects backplane 3 to a spout 32 of faucet 7, preferably via an internally threaded connector 34 which is attached to one end of rod 30 while its opposite end is connected to backplane 3. Rod 30 is preferably bent to be out of alignment with water flow 6.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An apparatus, comprising:

a brush assembly;

said brush assembly including a backplane with at least one brush attached to said backplane such that a plurality of bristles on said at least one brush faces outward from said backplane; and a clamping mechanism which removably attaches said brush assembly to a faucet;

wherein a longitudinal axis of the faucet is within a plane defined by the backplane; and wherein said clamping mechanism includes a rod having first and second ends, wherein said first end is directly connected to an end portion of said brush assembly and said second end is directly connected to said faucet.

2. An apparatus according to claim 1, wherein said second end is connected to said faucet via an internally threaded connecter which screws into a faucet head of said faucet.

3. An apparatus according to claim 1, wherein said at least one brush is two opposed brushes each facing outwards from said backplane.

* * * * *